US007948338B2

(12) United States Patent
Niimi et al.

(10) Patent No.: US 7,948,338 B2
(45) Date of Patent: May 24, 2011

(54) ELECTROMAGNETIC SWITCH EQUIPPED WITH BUILT-IN ELECTRONIC CONTROL CIRCUIT

(75) Inventors: Masami Niimi, Handa (JP); Yoshiaki Suzuki, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/461,117

(22) Filed: Jul. 31, 2009

(65) Prior Publication Data

US 2010/0033276 A1 Feb. 11, 2010

(30) Foreign Application Priority Data

Aug. 7, 2008 (JP) ..... 2008-204189

(51) Int. Cl.

| | |
|---|---|
| ***H01H 67/02*** | (2006.01) |
| ***H01H 9/00*** | (2006.01) |
| ***H01F 7/08*** | (2006.01) |
| ***H01F 7/18*** | (2006.01) |
| ***H01F 7/00*** | (2006.01) |

(52) U.S. Cl. ..... 335/126; 335/131; 335/184; 335/219; 335/220; 335/241; 335/260; 335/278; 335/290; 335/292; 335/294; 335/303

(58) Field of Classification Search ..... 335/126, 335/131, 184, 219, 220, 241, 260, 278, 290, 335/292, 294, 303

See application file for complete search history.

(56) References Cited

U.S. PATENT DOCUMENTS

| | | | | |
|---|---|---|---|---|
| 5,578,980 | A * | 11/1996 | Okubo et al. | 335/132 |
| 5,703,551 | A * | 12/1997 | Lefebvre et al. | 335/126 |
| 5,936,497 | A * | 8/1999 | Vilou | 335/126 |
| 5,990,771 | A * | 11/1999 | Quentric | 335/126 |
| 6,049,263 | A * | 4/2000 | Vilou | 335/126 |
| 6,124,775 | A * | 9/2000 | Linkner, Jr. | 335/278 |
| 2001/0005166 | A1 * | 6/2001 | Coulombier | 336/90 |
| 2005/0093665 | A1 * | 5/2005 | Imanishi et al. | 335/220 |
| 2008/0074219 | A1 * | 3/2008 | Hazzard et al. | 335/278 |

FOREIGN PATENT DOCUMENTS

| | | |
|---|---|---|
| EP | 0 751 292 A1 | 1/1997 |
| JP | A-09-105372 | 4/1997 |
| JP | A-10-106420 | 4/1998 |
| JP | A-10-154453 | 6/1998 |
| JP | A-10-308152 | 11/1998 |
| JP | A-2005-108530 | 4/2005 |

OTHER PUBLICATIONS

Notice of Allowance issued in Korean Patent Application No. 10-2009-0072543 dated Mar. 10, 2011 with English Translation.

* cited by examiner

*Primary Examiner* — Elvin G Enad
*Assistant Examiner* — Mohamad A Musleh
(74) *Attorney, Agent, or Firm* — Oliff & Berridge, PLC

(57) ABSTRACT

An electromagnetic switch is provided which is equipped with a built-in electronic control circuit working to control energization of an exciting coil. The electronic control circuit is disposed within a chamber defined by a magnetic plate to be separate from a contact chamber. In other words, the electronic control circuit is disposed between the magnetic plate and the exciting coil, thereby avoiding the adhesion of conductive dusts, as arising from the wear of contacts, to the surface of the electronic control circuit. This results in decreases in electric insulation and short-circuit of the electronic control circuit and also eliminates the need for additional special parts to electrically insulate and shield the electronic control circuit, thus permitting the electromagnetic switch to be reduced in size and produced at a decreased const.

4 Claims, 5 Drawing Sheets

ELECTROMAGNETIC SWITCH EQUIPPED WITH BUILT-IN ELECTRONIC CONTROL CIRCUIT

CROSS REFERENCE TO RELATED DOCUMENT

The present application claims the benefit of Japanese Patent Application No. 2008-204189 filed on Aug. 7, 2008, the disclosure of which is incorporated herein by reference.

BACKGROUND OF THE INVENTION

1. Technical Field of the Invention

The present invention relates generally to an electromagnetic switch which is equipped with a built-in electronic control circuit and to be installed in a starter to start an automotive engine.

2. Background Art

Japanese Patent First Publication No. 9-105372 discloses an electromagnetic switch equipped with a built-in electronic control circuit to control energization of an exciting coil.

The electromagnetic switch is designed to use attraction, as produced by an electromagnet developed by the exciting coil, to open or close main contacts of a motor circuit. The electronic control circuit is disposed inside a contact cover in which the main contacts are installed. This structure is small in size as compared with the case where the electronic control circuit is disposed in a casing separate from the electromagnetic switch in electric connection therewith and thus facilitates installation of the electromagnetic switch in an engine compartment of the automobile. The structure also eliminates the need for cables and connectors for connecting the electromagnetic switch and the electronic control circuit electrically.

Within the contact cover, the main contacts (i.e., fixed and movable contacts) are disposed, thus causing arcs, as produced upon opening or closing of the main contacts, to melt and blow the material of the main contacts as conductive dusts. The electronic control circuit is, therefore, exposed to the dusts, so that the dusts are deposited on the surface of the electronic control circuit, which may result in a decrease in electric insulation between electric devices mounted on the electronic control circuit and short-circuits therebetween.

Therefore, the installation of the electronic control circuit within the contact cover requires a circuit board and conductive leads connecting with the circuit board to be blocked or shielded by an electric insulator, which will result in increases in volume and manufacturing cost of the electromagnetic switch.

It is also necessary to place the electronic control circuit within the contact cover away from a path along which the movable contact is to move in an axial direction of the contact cover, which may result in complex configuration of the circuit board and complex layout of the electric devices on the circuit board, thus leading to a decrease in ease of installation of the electronic control circuit.

SUMMARY OF THE INVENTION

It is therefore a principal object of the invention to avoid the disadvantages of the prior art.

It is another object of the invention to provide an improved structure of an electromagnetic switch designed to install an electronic control circuit within an electromagnetic switch without being exposed to conductive dusts arising from the wear of contacts and interfering with a path along which a movable contact is to move.

According to one aspect of the invention, there is provided an electromagnetic switch which may be installed in a starter for internal combustion engines. The electromagnetic switch comprises: (a) a hollow cylindrical switch case with a bottom and an open end; (b) an exciting coil disposed within the switch case and working as an electromagnet when being energized; (c) a stationary core disposed inside the exciting coil in abutment with the bottom of the switch case; (d) an annular magnetic plate with a circular center hole, the magnetic plate being disposed within the switch case closer to the open end of the switch case than the exciting coil and working as a portion of a magnetic circuit; (e) a movable core disposed in alignment with the stationary core to be moved by magnetic attraction, as produced by the exciting coil, through the center hole of the magnetic plate inside the exciting coil in an axial direction of the switch case; (f) a resinous cover including a bottom portion and a hollow cylindrical portion, the hollow cylindrical portion having a first end continuing to the bottom portion of the resinous cover and a second end opposite the first end, the resinous cover being joined to the switch cover with the first end being in abutment with an inner periphery of the open end of the switch case and the second end being in abutment with one of end surfaces of the magnetic plate which is away from the exciting coil to define a contact chamber between itself and the magnetic plate; (g) a first terminal bolt retained in the bottom portion of the resinous cover, the first terminal bolt having a first fixed contact disposed within the contact chamber; (h) a second terminal bolt retained in the bottom portion of the resinous cover, the first terminal bolt having a second fixed contact disposed within the contact chamber; (i) a movable contact disposed within the contact chamber, the movable contact being to be moved by motion of the movable core to establish and block electrical connection between the first and second fixed contacts selectively; and (j) an electronic control circuit working to control energization of the exciting coil. The electronic control circuit is disposed between the exciting coil and the magnetic plate.

Specifically, the electronic control circuit is disposed within a chamber defined by the magnetic plate to be separate from the contact chamber, thereby avoiding the adhesion or deposition of conductive dusts, as arising from the wear of the contacts, to or on the surface of the electronic control circuit. This results in decreases in electric insulation and short-circuit of the electronic control circuit and also eliminates the need for additional special parts to electrically insulate and shield the electronic control circuit, thus permitting the electromagnetic switch to be reduced in size and produced at a decreased const.

The adhesion of the conductive dusts to the surface of the electronic control circuit may alternatively be avoided by placing the electronic control circuit on the side of the exciting coil away from the magnetic plate, that is, on the bottom of the switch case. This, however, results in a difficulty in handling a lead terminal and a ground terminal for supplying the power to the electronic control circuit. Specifically, the lead terminal may be drawn outside the resinous cover through a hole formed in the bottom of the resinous cover. The ground lead may be welded to the end surface of the magnetic plate away from the exciting coil. This requires the lead terminal and the ground lead to pass over the outer periphery of the exciting coil, thus resulting in an increase in outer diameter of the switch case which leads to an increased size of the electromagnetic switch.

However, the structure of the electromagnetic switch is designed to have the electronic control circuit disposed between the exciting coil and the magnetic plate, thus eliminating the need for extending the lead terminal and the ground lead over the outer periphery of the exciting coil and avoiding the increase in size of the electromagnetic switch.

In the preferred mode of the invention, the electromagnetic switch may further comprise a resinous bobbin around which the exciting coil is wound and an annular support member with an outer peripheral wall and an inner peripheral wall. The support member is formed integrally with an end of the bobbin. The electronic control circuit has a circuit board which has an inner and an outer periphery. At least one of the inner and outer periphery of the circuit board is fit on one of the inner and outer peripheral walls of the support member. This structure results in a decrease in relative vibration between the circuit board of the electronic control circuit and the exciting coil wound around the bobbin when external vibration is exerted on the electromagnetic switch, thereby decreasing the stress arising from the vibration exerted on leads connecting between the electronic control circuit and the exciting coil to ensure the stability of joints between the electronic control circuit and the exciting coil. The above structure also eliminates the need for an additional special member to retain the electronic control circuit, thus facilitating the ease of firm installation of the electronic control circuit and minimizing the production cost of the electromagnetic switch.

The circuit board of the electronic control circuit may be molded integrally with the bobbin. This enhances the resistance to external vibration acting on the circuit board and the bobbin.

The electromagnetic switch further comprise a chamber defined between an end of the resinous bobbin and the circuit board of the electronic control circuit. The chamber is filled with a resin material which is lower in thermal conductivity than the bobbin. This reduces the heat which is produced by energization of the exciting coil and transmitted to the electronic control circuit, which permits the ability of the electronic control circuit to withstand a rise in temperature of the exciting coil.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
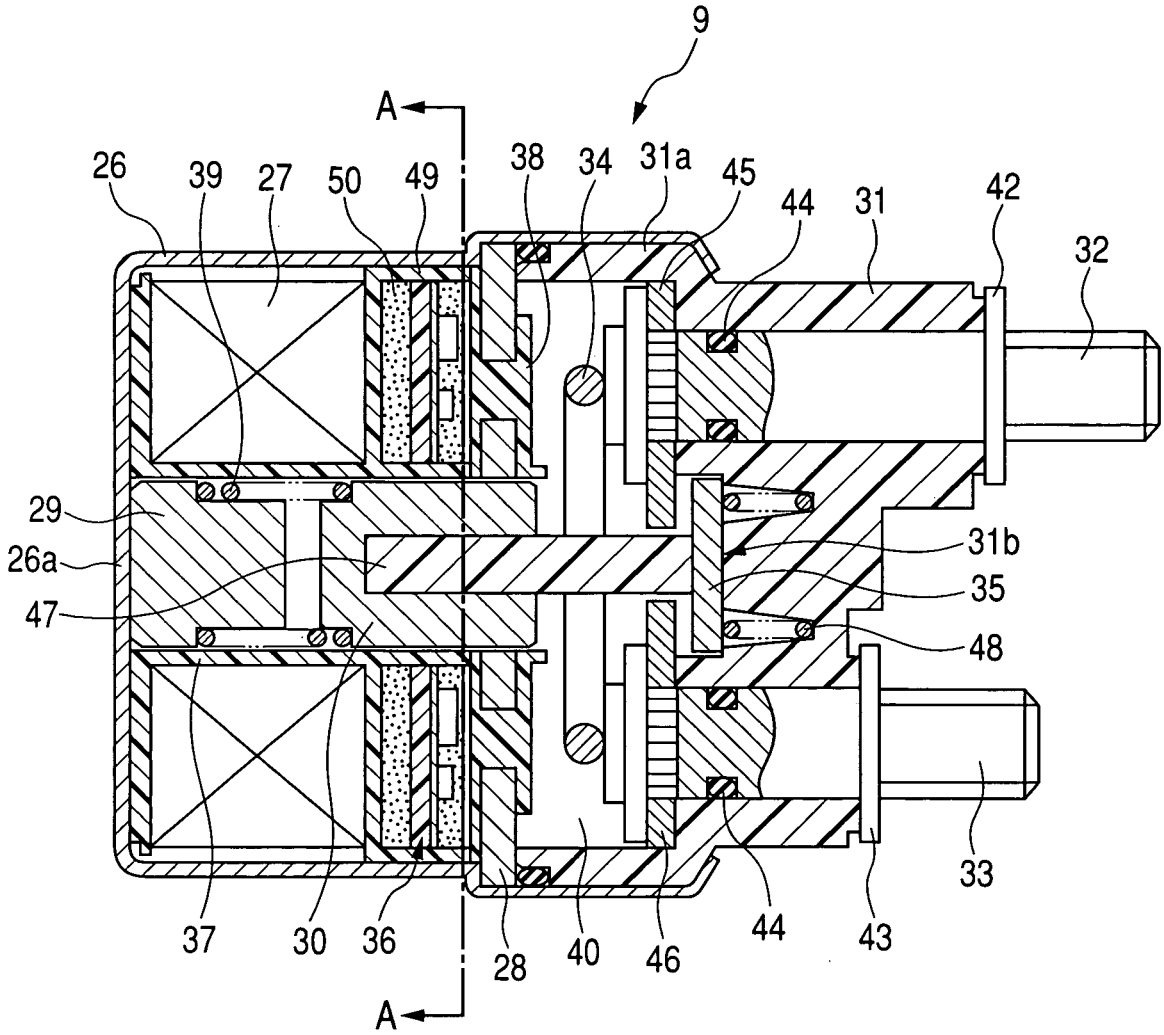
FIG. 1 is a longitudinal sectional view which shows an internal structure of a sub-electromagnetic switch according to an embodiment of the invention.
Figure 2:
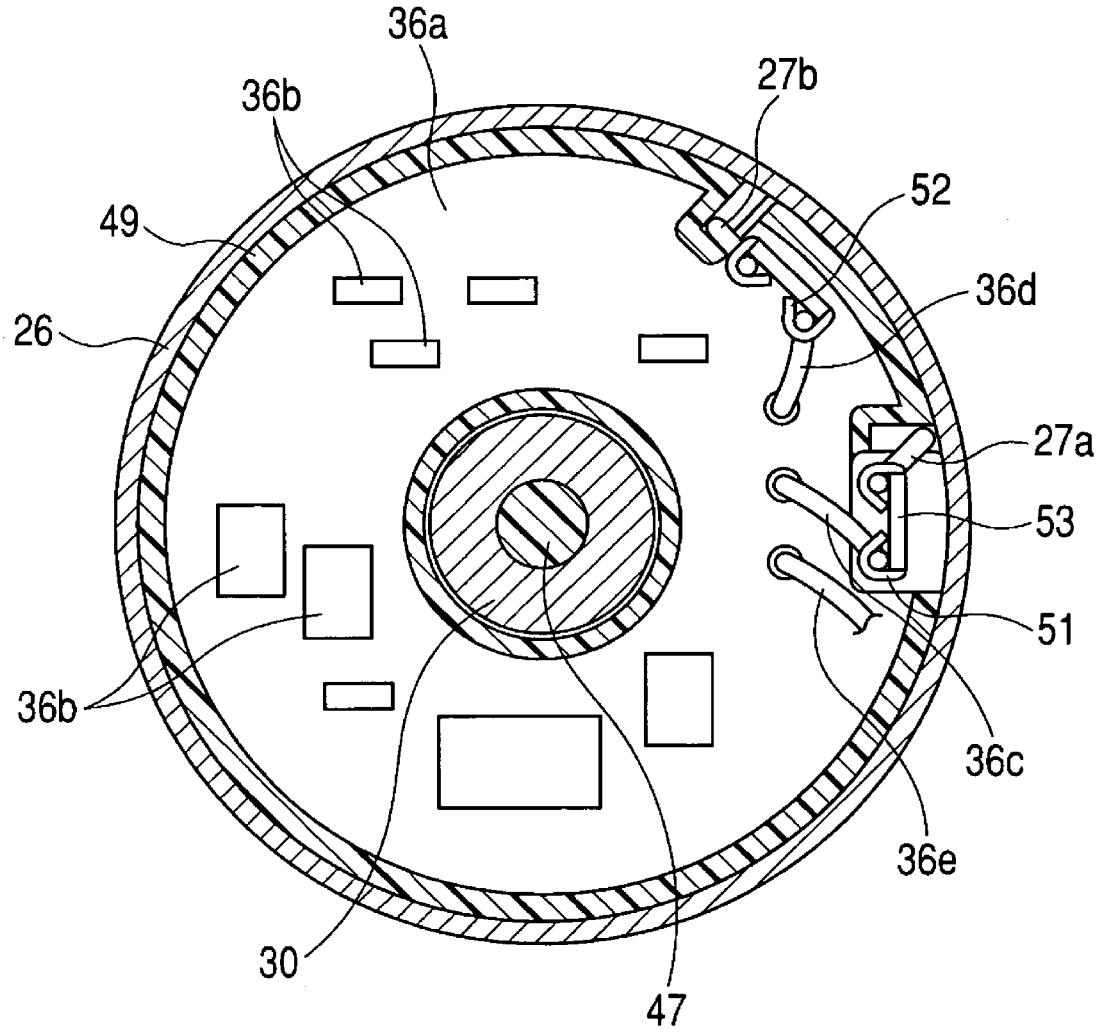
FIG. 2 is a traverse sectional view, as taken along the line A-A in FIG. 1.
Figure 3:
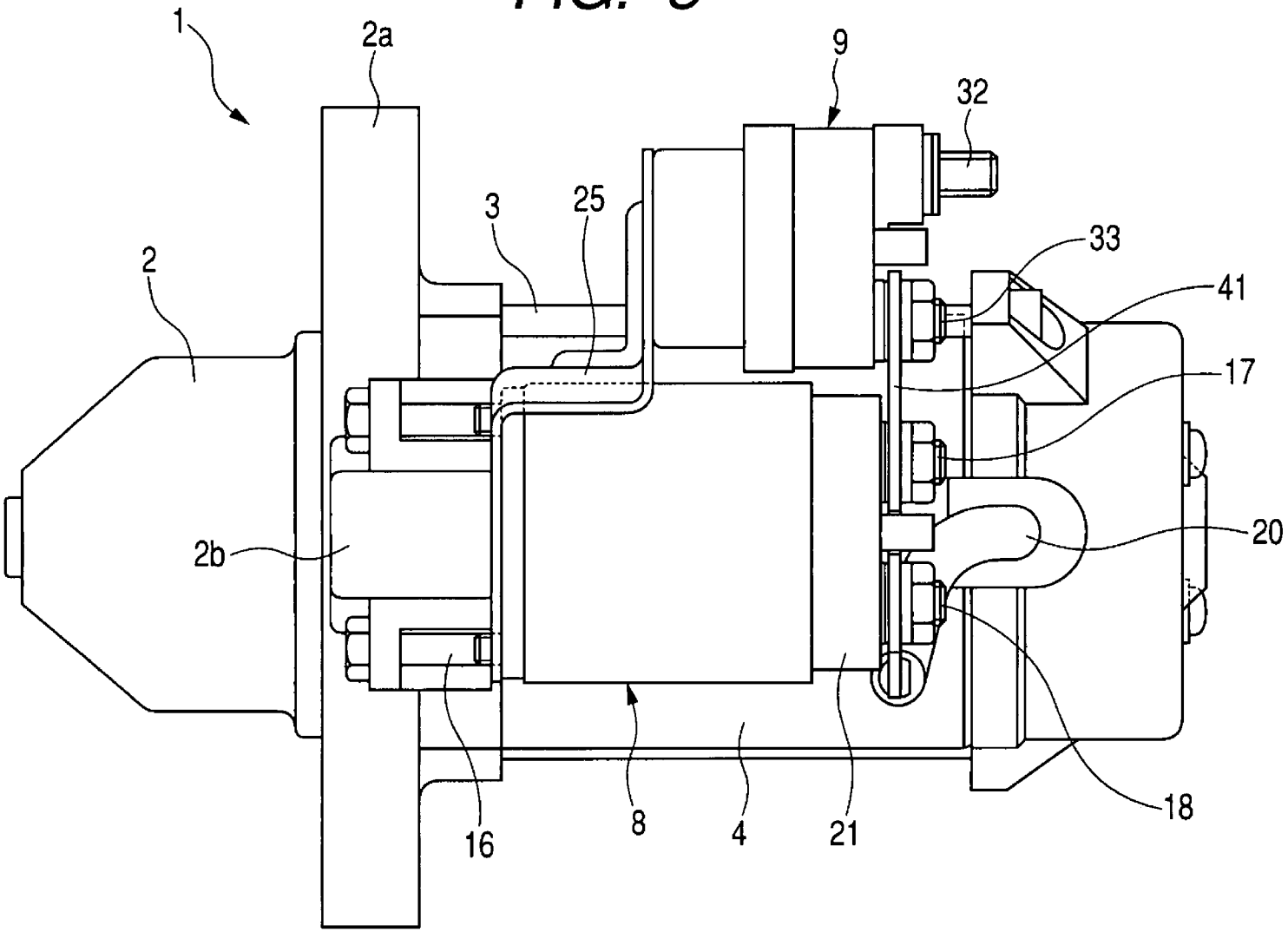
FIG. 3 is a side view which shows a starter equipped with the sub-electromagnetic switch of FIG. 1.
Figure 4:
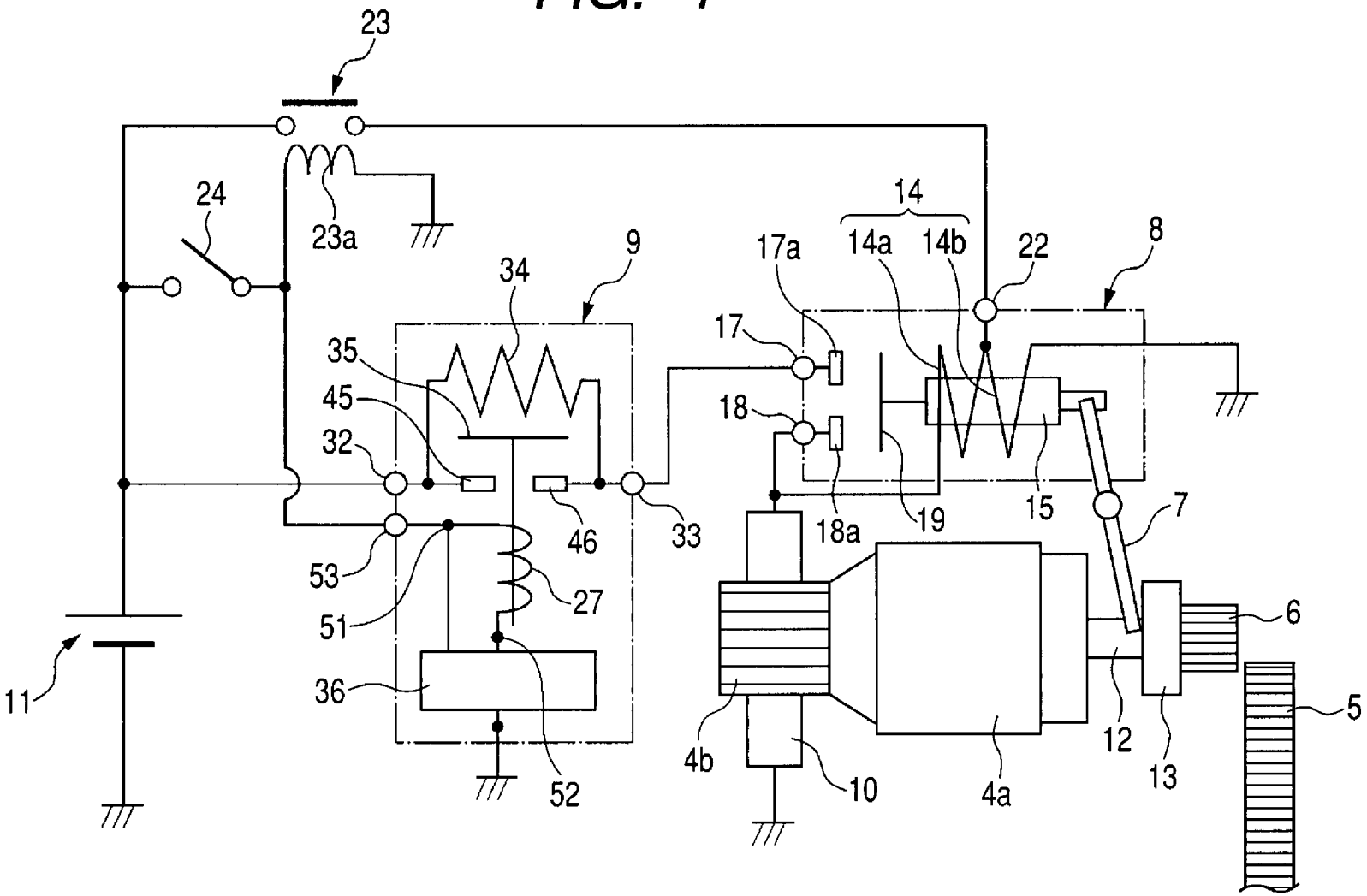
FIG. 4 is a block diagram which shows a circuit structure of the starter of FIG. 3.

Referring to the drawings, wherein like reference numbers refer to like parts in several views, particularly to FIG. 1, there is shown an electromagnetic switch 9 which is installed, as an example, in an automotive engine starter 1 illustrated in FIG. 3. FIG. 1 is a longitudinal sectional view of the electromagnetic switch 9. FIG. 2 is a traverse sectional view, as taken along the line A-A of FIG. 1. FIG. 3 is a plane view of the starter 1. FIG. 4 is a diagram which shows an electric circuit for the starter 1.

The starter 1 is, as illustrated in FIGS. 3 and 4, equipped with a housing 2, an electric motor 4, a pinion gear 6, a shift lever 7, a main electromagnetic switch 8, and the electromagnetic switch 9. The electromagnetic switch 9 is used as an auxiliary switch and will be referred to as a sub-electromagnetic switch below.

The housing 2 is to be secured to an automotive internal combustion engine (not shown). The electric motor 4 is joined to the housing 2 using through bolts 3. The pinion gear 6, as can be seen in FIG. 4, works to transmit torque, as produced by the motor 4, to a ring gear 5 attached to the engine. The main electromagnetic switch 8 works to open or close main contacts, as will be described later in detail, which are installed in a motor circuit and also works to push the pinion gear 6 away from the motor 4 (i.e., a leftward direction, as viewed in FIG. 4) through the shift lever 7. The sub-electromagnetic switch 9 is located electrically upstream of the main electromagnetic switch 8 in the motor circuit.

The housing 2 includes a flange 2*a* to be secured to a starter mount surface of the engine and a switch mount 2*b* on which the main electromagnetic switch 8 is mounted firmly.

The electric motor 4 is of a commutator motor type which, as illustrated in FIG. 4, has an armature 4*a* and a commutator 4*b* disposed on an end of the armature 4*a*. When the main electromagnetic switch 8 closes the main contacts, it will cause the armature 4*a* to be energized by electric power from a storage battery 11 through brushes 10 riding on the commutator 4*b*, so that the armature 4*a* produced the torque.

The pinion gear 6 is fit on an outer periphery of an output shaft 12, as driven by the motor 4, integrally with a one-way clutch 13. The torque of the output shaft 12 is transmitted to the pinion gear 6 through the one-way clutch 13.

The main electromagnetic switch 8 is, as illustrated in FIG. 4, made by a solenoid having a switch coil 14 and a plunger 15 installed therein. When the switch coil 14 is excited, it will serve as electromagnet to produce a magnetic attraction to attract the plunger 15. Such movement of the plunger 15 causes the main contacts to be closed. When the switch coil 14 is deenergized, so that the magnetic attraction disappears, it causes the plunger 15 to be moved back by a reactive pressure, as produced by a spring (not shown) to open the main contacts. The main electromagnetic switch 8 is, as can be seen in FIG. 3, joined to the switch mount 2*b* of the housing 2 tightly through two bolts 16.

The main contacts are, as illustrated in FIG. 4, implemented by two fixed contacts 17*a* and 18*a* connected to the motor circuit through two terminal bolts 17 and 18. The plunger 15 has disposed thereon a movable contact 19 which opens or closes, that is, disconnects or connects the fixed contacts 17*a* and 18*a* electrically.

The terminal bolts 17 and 18 serve as a typical B-terminal and a typical M-terminal. The B-terminal is connected to a high potential side of the motor circuit, while the M-terminal is connected electrically to the positive side brush 10 through a motor lead 20, as illustrated in FIG. 3. The terminal bolts 17 and 18 are secured to a contact cover 21. Heads of the terminal bolts 17 and 18 are disposed inside the contact cover 21 and have the fixed contacts 17*a* and 18*a* disposed thereon integrally.

The switch coil 14 is made of an assembly of two coils: an attraction coil 14*a* and a holding coil 14*b*. The attraction coil 14*a* are connected electrically at an end thereof to an excitation terminal 22, as illustrated in FIG. 4, secured to the contact cover 21 and at the other end to the M-terminal bolt 18. The holding coil 14*b* are connected electrically at an end thereof to the excitation terminal 22 along with the attraction coil 14*a* and at the other end to ground (e.g., a stationary core of the main electromagnetic switch 8).

The excitation terminal 22 is connected to the battery 11 through a starter relay 23. When an ignition switch 24 of the vehicle is closed, so that the starter relay 23 is turned on, the electric current is supplied from the battery 11 to the excitation terminal 22 through the starter relay 23.

The structure of the sub-electromagnetic switch 9 will be described in detail with reference to FIGS. 1 and 3.

The sub-electromagnetic switch 9 is, as illustrated in FIG. 3, located close to the main electromagnetic switch 8 in a radius direction of the main electromagnetic switch 8. The sub-electromagnetic switch 9 is secured to the housing 2 through a bracket 25.

The bracket 25 is made of a strip plate which has a substantially circular end to which the sub-electromagnetic switch 9 is welded and the other end with two circular holes (not shown). The other end is retained between the switch mount 2*b* of the housing 2 and the main electromagnetic switch 8 and joined to the housing 2 along with the main electromagnetic switch 8 by the bolts 16 fit in the two circular holes.

The sub-electromagnetic switch 9, as illustrated in FIG. 1, includes a hollow cylindrical switch case 26 with a bottom and an open end, an exciting coil 27, a magnetic plate 28, a stationary core 29 (i.e., a magnetic core), a movable core 30, a resinous cover 31, terminal bolts 32 and 33, a resistor 34, sub-contacts, will be described later in detail, provided on the terminal bolts 32 and 33, a movable contact 35, and an electronic control circuit 36. The exciting coil 27 is disposed within the switch case 26. The magnetic plate 28 is disposed inside the open end of the switch case 26 and works as a part of the magnetic circuit. The stationary core 29 is magnetized by the excitation of the exciting coil 27. The movable core 30 is placed in alignment with the stationary core 29. The resinous cover 31 is partially disposed in the switch case 26 in abutment with the magnetic plate 28. The terminal bolts 32 and 33 are fit tightly in the resinous cover 31. The resistor 34 is placed within the switch case 26 in connection with the terminal bolts 32 and 33. The movable contact 35 is to be moved by the motion of the movable core 30 to open or close the sub-contacts. The electronic control circuit 36 works to control the excitation of the exciting coil 27.

The switch case 26 has a small-diameter portion within which the exciting coil 27 is disposed and a large-diameter portion within which the magnetic plate 28 is disposed. The large-diameter portion leads to the open end and is greater in outer diameter greater than the small-diameter portion to define an inner shoulder therebetween.

The exciting coil 27 is wound around a resinous bobbin 37 and serves as an electromagnet when energized.

The magnetic plate 28 is of an annular shape with a center hole. The magnetic plate 28 is placed in abutment with the inner shoulder of the switch case 26, so that it is located at a fixed distance from the exciting coil 27. The magnetic plate 28 is outsert-molded with a resinous member 38.

The stationary core 29 is disposed in abutment with the bottom 26*a* of the switch case 26 within the inner periphery of the exciting coil 27.

The movable core 30 is disposed inside the exciting coil 27 to be movable through the center hole of the magnetic plate 28 in an axial direction of the exciting coil 27. A return spring 39 is disposed between outer shoulders of the movable core 30 and the stationary core 29 to urge the movable core 30 away from the stationary core 29 (i.e., a rightward direction, as viewed in FIG. 1).

The resinous cover 31 is of a hollow cylindrical shape with a bottom portion and has a leg portion (i.e., a hollow cylindrical large-diameter portion) 31*a*. The bottom portion has installed therein the terminal bolts 32 and 33. The leg portion 31*a* has an outer shoulder placed in abutment with the open end of the switch case 26 and a rear end placed in abutment with an outer periphery of an end surface of the magnetic plate 28. The entire or partial circumference of the open end of the switch case 26 is crimped to retain the leg portion 31*a* of the resinous cover 31 firmly. The resinous cover 31 has a contact chamber 40 defined by an inner wall thereof and the magnetic plate 28.

The terminal bolt 32 is connected to a positive terminal of the battery 11 through a battery cable and will also be referred to as a first terminal bolt 32. The terminal bolt 33 is connected mechanically and electrically to the B-terminal bolt 17 of the main electromagnetic switch 8 through a metallic connecting plate 41, as illustrated in FIG. 3, and will also be referred to as a second terminal bolt. The first and second terminal bolts 32 and 33 are fixed to the resinous cover 31 through washers 42 and 43. Each of the first and second terminal bolts 32 and 33 has formed in an outer circumference thereof an angular groove in which a sealing member such as an O-ring 44 is fit to create a hermetical sealing between itself and a corresponding one of bolt mount holes formed in the resinous cover 31.

The first and second terminal bolts 32 and 33 have affixed thereto first and second fixed contacts 45 and 46, respectively, which serve as the sub-contacts, as described above. The first and second fixed contacts 45 and 46 are disposed within the contact chamber 40 of the resinous cover 31. The first and second fixed contacts 45 and 46 are illustrated in FIG. 1 as being press-fit on knurled peripheral portions of the heads of the first and second terminal bolts 32 and 33, but may alternatively be joined thereto through brazing or soldering.

The movable contact 35 is disposed in the contact chamber 40 and faces the sub-contacts (i.e., the first and second fixed contacts 45 and 46). The movable contact 35 is joined to the movable core 30 through a resinous rod 47. The movable core 30 is, as described above, urged by the return spring 39 away from the stationary core 29 to bring the movable contact 35 into constant abutment with a contact stopper 31*b* formed on the bottom of the resinous cover 31. The bottom of the resinous cover 31 has formed around the frusto-conical shaped contact stopper 31*b* an annular groove or chamber in which a contact press spring 48 is disposed. When the movable contact 35 is placed in abutment with the first and second fixed contacts 45 and 46, the contact press spring 48 works to exert a given contact pressure on the movable contact 35.

The resistor 34 works as current control means for controlling the current supplied to the motor 4. The resistor 34 is disposed in the contact chamber 40 and connected at an end thereof to the first terminal bolt 32 and at the other end thereof to the second terminal bolt 33 electrically and mechanically. The resistor 34 is located at given distances from the magnetic plate 28 and the sub-contacts (i.e., the first and second fixed contacts 45 and 46), respectively. Additionally, the resistor 34 is also located at a given distance from the inner periphery of the resinous cover 31 in order to avoid thermal damage to the resinous cover 31 when the resistor 34 is energized continuously, so that it glows.

The electronic control circuit 36, as illustrated in FIG. 2, has an annular circuit board 36*a* on which electronic devices 36*b* are fabricated and works to energize the exciting coil 27 of the sub-electromagnetic switch 9 given seconds t after the ignition switch 24 is turned on to energize the switch coil 14 of the main electromagnetic switch 8. The electronic control circuit 36, as illustrated in FIG. 1, is disposed between the exciting coil 27 and the magnetic plate 28 within the switch case 26. The circuit board 36*a* is fit at an outer periphery and/or an inner periphery thereof on a support 49 formed integrally with the bobbin 37 as a one-piece unit.

The support 49 is, as illustrated in FIG. 1, of a cup-shape with an inner and an outer cylindrical walls which extend from an inner and an outer peripheral edge of the end surface of the bobbin 37 abutting the end of the exciting coil 27 facing the electromagnetic plate 28 (rightward, as viewed in the drawing).

The circuit board 36*a* of the electronic control circuit 36 is disposed away from the end of the bobbin 37 to define an annular chamber filled with resin material 50 which is lower in thermal conductivity than the bobbin 37.

The electronic control circuit 36, as illustrated in FIG. 2, has two conducting leads 36*c* and 36*d* and a ground lead 36*e* extending therefrom. The lead 36*c* is joined electrically and mechanically to the end 27*a* of the exciting coil 27 in a first connector 51. The lead 36*d* is joined electrically and mechanically to the end 27*b* of the exciting coil 27 in a second connector 52. The ground lead 36*e* is joined or welded electrically and mechanically to, for example, the end of the electromagnetic plate 28 away from the exciting coil 27.

To the first connector 51, an external lead terminal 53 is joined mechanically and electrically. The external lead terminal 53 extends outside the resinous cover 31 through a hole (not shown) formed in the resinous cover 31 and connects, as illustrated in FIG. 4, with the ignition switch 24.

Figure 5:
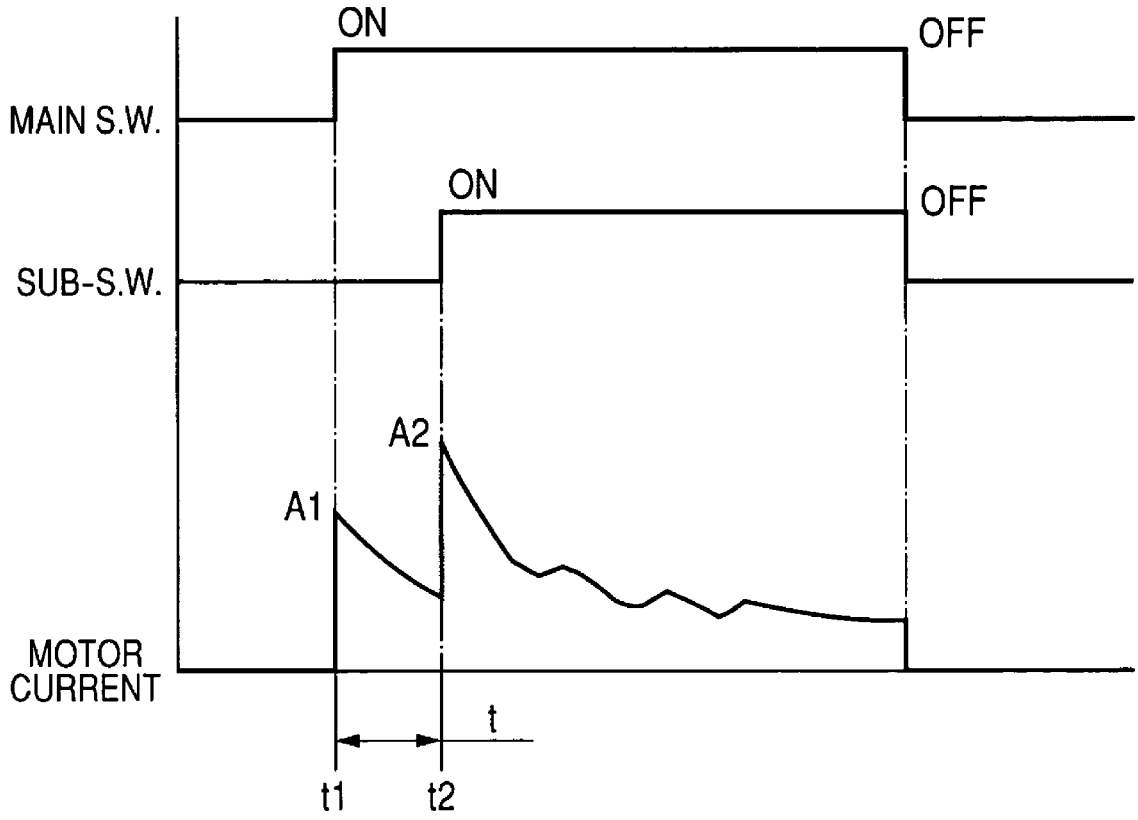
FIG. 5 is a time chart which demonstrates an operation of the starter of FIG. 3.

The operation of the starter 1 will be described below with reference to a time chart of FIG. 5.

When the ignition switch 24 is turned on, the starter relay 23 is turned on. This causes the switch coil 14 of the main electromagnetic switch 8 to be energized at time t1 by the power supplied from the battery 11. The exciting coil 27 of the sub-electromagnetic switch 9 is, as can be seen from FIG. 1, connected in parallel to the coil 23*a* of the starter relay 23 and energized, as described above, by the electronic control circuit 36 t seconds after the switch coil 14 is energized. This causes the main electromagnetic switch 8 to attract the plunger 15 in the left direction, as viewed in FIG. 4, thereby pushing the pinion gear 6 away from the motor 4 (i.e., the right direction in FIG. 4) through the shift lever 7.

Afterwards, when the main contacts (i.e., the fixed contacts 17*a* and 18*a*) are closed, it will cause the current value A1 which has been supplied from the battery 11 and controlled by the resistor 34 to be applied to the motor 4, so that the motor 4 rotates at a low speed.

After the pinion 6 is rotated by the motor 4 and meshes with the ring gear 5, the electronic control circuit 36 energizes the exciting coil 27 of the sub-electromagnetic switch 9 at time t2. The movable contact 35 is, therefore, attracted to close the sub-contacts (i.e., the first and second fixed contacts 45 and 46), thereby making a short-circuit path to short-circuit the resistor 34. This causes the entire voltage, as produced by the battery 11, to be applied to the motor 4, so that current value A2 which is greater than the current value A1 flows through the motor 4. The motor 4 then rotates at a high speed, so that the torque is transmitted to the ring gear 5 through the pinion gear 6, thereby cranking the engine.

The starter 1 of this embodiment is designed to supply the current value A1, as controlled by the resistor 34, to the motor 4 during an initial stage from closing of the main contacts to closing of the sub-contacts, thereby reducing a mechanical impact arising from engagement of the pinion gear 6 with the ring gear 5 to minimize the mechanical wear of the pinion gear 6 and the ring gear 5 which ensures the durability thereof.

The inrush current flowing through the motor 4 upon start of rotation thereof is also decreased, thus resulting in improved service life of the main contacts of the main electromagnetic switch 8 and the brushes 10 of the motor 4.

The electronic control circuit 36 is disposed within the chamber, as separated by the magnetic plate 28 from the switch chamber 40 between the exciting coil 27 and the magnetic plate 28, thereby eliminating the adhesion of conductive dusts, as produced by the wear of the sub-contacts, to the surface of the electronic control circuit 36. This results in decreases in electric insulation and short-circuit of the electronic control circuit 36 and also eliminates the need for additional special parts to electrically insulate and shield the electronic control circuit 36.

The movable contact 35 is not located within the chamber in which the electronic control circuit 36 is installed, thus permitting the configuration of the circuit board 36*a* and layout of the circuit devices 36*b* to be selected regardless of a path of travel of the movable contact 35 and facilitating the ease of installation of the electronic control circuit 36 in the sub-electromagnetic switch 9.

The adhesion of conductive dusts, as arising from the wear of the sub-contacts within the switch chamber 40, to the surface of the electronic control circuit 36 may alternatively be avoided by placing the electronic control circuit 36 on the side of the exciting coil 27 away from the magnetic plate 28, that is, on the bottom 26*a* of the switch case 26. This, however, results in a difficulty in handling the external lead terminal 53 and the ground terminal 36*e* for supplying the power to the electronic control circuit 36. Specifically, the external lead terminal 53 may be drawn outside the resinous cover 31 through the hole formed in the bottom of the resinous cover 31. The ground lead 36*e* of the electronic control circuit 36 is connected or welded to the end surface of the magnetic plate 28 away from the exciting coil 27. This requires the external lead terminal 53 and the ground lead 36*e* to pass over the outer periphery of the exciting coil 27, thus resulting in an increase in outer diameter of the switch case 26 which leads to an increased size of the sub-electromagnetic switch 9.

However, the structure of the starter 1 of this embodiment is designed to have the electronic control circuit 36 disposed between the exciting coil 27 and the magnetic plate 28, thus eliminating the need for extending the external lead terminal 53 and the ground lead 36*e* over the outer periphery of the exciting coil 27 and avoiding the increase in size of the sub-electromagnetic switch 9.

The circuit board 36*a* of the electronic control circuit 36 is, as described above, fit at the outer and/or inner periphery thereof on the outer and/or inner peripheral wall of the support 49. This results in a decrease in relative vibration between the circuit board 36*a* of the electronic control circuit 36 and the exciting coil 27 wound around the bobbin 37 when external vibration is transmitted to the sub-electromagnetic switch 9, thereby decreasing the stress arising from the vibration exerted on leads connecting between the electronic control circuit 36 and the exciting coil 27 to ensure the stability of joints between the electronic control circuit 36 and the exciting coil 27. The above structure also eliminates the need for an additional special member to retain the electronic control circuit 36, thus facilitating the ease of firm installation of the electronic control circuit 36 and minimizing the production cost of the starter 1.

The chamber formed between the end of the bobbin 37 and the circuit board 36*a* of the electronic control circuit 36 is filled with the resin material 50 which is lower in thermal conductivity than the bobbin 37, thereby reducing the heat which is produced by energization of the exciting coil 27 and transmitted to the electronic control circuit 36, which permits the ability of the electronic control circuit 36 to withstand a rise in temperature of the exciting coil 27.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

The circuit board 36*a* of the electronic control circuit 36 may be molded integrally with the bobbin 37 of the exciting coil 27. In this case, the exciting coil 27 is retained together with the circuit board 36*a* of the electronic control circuit 36, thereby increasing the resistance to external vibrations.

What is claimed is:

1. An electromagnetic switch comprising:

a hollow cylindrical switch case with a bottom and an open end;

an exciting coil disposed within said switch case and working as an electromagnet when being energized;

a stationary core disposed inside said exciting coil in abutment with the bottom of said switch case;

an annular magnetic plate with a circular center hole, said magnetic plate being disposed within said switch case closer to the open end of said switch case than said exciting coil and working as a portion of a magnetic circuit;

a movable core disposed in alignment with said stationary core to be moved by magnetic attraction, as produced by said exciting coil, through the center hole of said magnetic plate inside said exciting coil in an axial direction of said switch case;

a resinous cover including a bottom portion and a hollow cylindrical portion, the hollow cylindrical portion having a first end continuing to the bottom portion of said resinous cover and a second end opposite the first end, said resinous cover being joined to said switch case with the first end being in abutment with an inner periphery of the open end of said switch case and the second end being in abutment with one of end surfaces of said magnetic plate which is away from said exciting coil to define a contact chamber between itself and said magnetic plate;

a first terminal bolt retained in the bottom portion of said resinous cover, said first terminal bolt having a first fixed contact disposed within the contact chamber;

a second terminal bolt retained in the bottom portion of said resinous cover, said first terminal bolt having a second fixed contact disposed within the contact chamber;

a movable contact disposed within the contact chamber, said movable contact being to be moved by motion of said movable core to establish and block electrical connection between the first and second fixed contacts selectively; and an electronic control circuit working to control energization of said exciting coil, said electronic control circuit being disposed between said exciting coil and said magnetic plate.

2. The electromagnetic switch as set forth in claim 1, further comprising a resinous bobbin around which said exciting coil is wound and an annular support member with an outer peripheral wall and an inner peripheral wall, said support member being formed integrally with an end of the resinous bobbin, and wherein said electronic control circuit has a circuit board which has an inner and an outer periphery, at least one of the inner and outer periphery of the circuit board being fit on one of the inner and outer peripheral walls of said support member.

3. The electromagnetic switch as set forth in claim 1, further comprising a resinous bobbin around which said exciting coil is wound, and wherein a circuit board of said electronic control circuit is molded integrally with the resinous bobbin.

4. The electromagnetic switch as set forth in claim 1, further comprising a chamber defined between an end of a resinous bobbin and a circuit board of said electronic control circuit, and wherein said chamber is filled with a resin material which is lower in thermal conductivity than the resinous bobbin.

* * * * *